United States Patent [19]

Zettier et al.

[11] 4,410,319

[45] Oct. 18, 1983

[54] SELF-DISCHARGING CENTRIFUGAL DRUM

[75] Inventors: Karl-Heinz Zettier; Hugo Zurbrüggen, both of Oelde, Fed. Rep. of Germany

[73] Assignee: Westfalia Separator AG, Oelde, Fed. Rep. of Germany

[21] Appl. No.: 372,786

[22] Filed: Apr. 28, 1982

[30] Foreign Application Priority Data

May 6, 1981 [DE] Fed. Rep. of Germany ..... 3117807

[51] Int. Cl.[3] ..... B04B 11/00

[52] U.S. Cl. ..... 494/29; 494/56

[58] Field of Search ..... 494/27, 29, 30, 56; 137/39, 44

[56] References Cited

U.S. PATENT DOCUMENTS

| | | | |
|---|---|---|---|
| 3,754,701 | 8/1973 | Bruning | 494/27 |
| 3,765,599 | 10/1973 | Hemfort | 494/30 X |
| 4,151,951 | 5/1979 | Kohlstette | 494/30 |

*Primary Examiner*—Harvey C. Hornsby

*Assistant Examiner*—Christine A. Peterson

*Attorney, Agent, or Firm*—Sprung, Horn, Kramer & Woods

[57] ABSTRACT

A self-discharging centrifugal drum for clarifying and separating suspensions, has an axially displaceable piston valve that is bounded above by a solids space and that opens and closes expulsion openings in the drum jacket. A closure compartment that can be charged with closure fluid and that can be evacuated through a centrifugal valve in the drum jacket is disposed below the piston valve. A second fluid-controlled centrifugal valve in the drum jacket is connected through connecting channels to the closure compartment and through a connecting channel with a reservoir in the drum jacket that is always charged with closure fluid and subjected to fluid pressure when the drum is in operation. When the closure compartment is evacuated, a valve cone in the second centrifugal valve opens to establish a connection between the closure compartment and the reservoir. This permits not only sudden evacuation but also just as sudden charging of the closure compartment with closure fluid.

9 Claims, 1 Drawing Figure

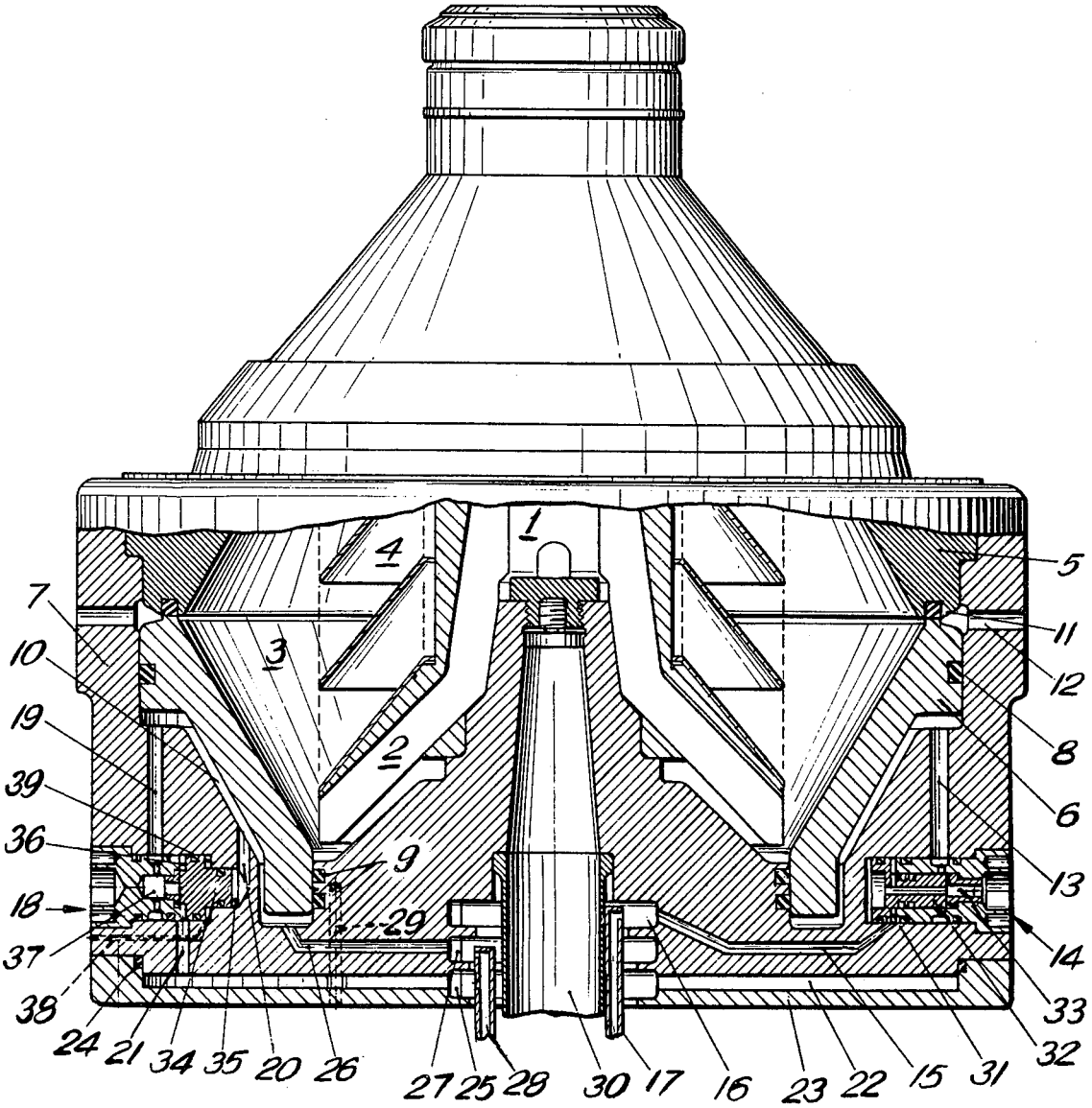
1
2
3
4
5
6
7
8
9
10
11
12
13
14
15
16
17
18
19
20
21
22
23
24
25
26
27
28
29
30
31
32
33
34
35
36
37
38
39

SELF-DISCHARGING CENTRIFUGAL DRUM

BACKGROUND OF THE INVENTION

The present invention relates to a self-discharging centrifugal drum for clarifying and separating suspensions that has an axially displaceable piston valve than opens and closes expulsion openings in the circumference of the drum jacket to allow the removal of centrifuged solids, in which the top of the piston valve is bounded by the solids space and its bottom by a closure compartment into which closure fluid can be pumped, in which the closure fluid is supplied through a channel that is connected to the closure compartment, in which the closure compartment is evacuated by means of a centrifugal valve in the drum jacket, and in which the centrifugal valve is connected to the closure compartment by an evacuation channel that begins at the outside of the closure compartment.

A centrifugal drum of this type is known, for example, from German Pat. No. 2 436 285. This centrifugal drum can be what may be called partially or completely discharged, depending on the suspension and on the centrifuged solids, by means of the axially displaceable piston valve. In this process part or all of the drum packing is expelled through expulsion openings in the circumference of the drum.

Two conditions are necessary to ensure uniform expulsion of the drum packing and especially of the solids centrifuged into the outer zone of the solids compartment. First, the piston valve must open suddenly, leaving a wide opening gap between it and the site where it is sealed off against the drum cover. Second, the piston valve must close suddenly, especially when discharge is only partial. To ensure a uniformly wide opening gap in the drum during both partial and complete discharge, all the closure fluid must always be evacuated from the closure compartment, which must then be recharged with closure fluid at a rate that corresponds to the desired level to which the drum is to be discharged.

Although known centrifugal drums do allow rapid total discharge of the drum packing with a wide piston-valve opening gap, they can not be precisely partially discharged because the closure compartment can not be uniformly and rapidly enough recharged with fresh closure fluid. Closure fluid is introduced from a supply connection into an annular compartment near the axis of the drum jacket and then transported out through channels into the closure compartment, which always takes a relatively long time because the closure fluid, which is introduced under practially no pressure, must be accelerated and brought up to pressure in the centrifugal drum.

For these reasons some self-discharging centrifugal drums are often designed only for partial discharge and others only for complete discharge of the drum packing.

Since, however, there are so many applications for self-discharging centrifugal drums, versions have become known that are supposed to be equally effective for either partial, and uniform, or complete discharge. German Pat. No. 2 048 429 for example discloses a centrifugal drum with a two-part closure compartment between the piston valve and the surrounding part of the drum that is charged with closure fluid before centrifuging commences. Each of the two divisions in the two-part closure compartment is connected to a fluid-activated centrifugal valve that evacuates the closure fluid. Whereas, during partial discharge, the centrifugal valves remove closure fluid from only the inner or the outer division, during complete discharge closure fluid is removed simultaneously from both divisions. In the latter case both centrifugal valves must be opened uniformly, which is, however, very difficult in practice.

For these reasons the self-discharging centrifugal drum known from German Pat. No. 2 704 903 was proposed. This drum also has a two-part closure compartment and two valves, and the channel that evacuates the inner division of the closure compartment opens into the outer division. The centrifugal valves are located in the evacuation channels. The communication between the divisions of the closure compartment causes the centrifugal valve associated with the inner division to open during complete discharge when the outer centrifugal valve, and hence the outer division, open, so that both the outer and the inner divisions will evacuate uniformly and in sequence. This opens the drum rapidly. In partial discharge it is essentially only the outer division that is evacuated. The relatively long channels required to charge the divisions of the closure compartment in this drum, however, make it also close rather sluggishly.

SUMMARY OF THE INVENTION

The main object of the present invention is to provide a simple self-discharging centrifugal drum that will open and close rapidly during both partial and complete discharge and in which the piston-valve opening gap will be at a maximum.

This objective is attained in accordance with the invention by, firstly providing another fluid-activated centrifugal valve located in the drum jacket and connected through connecting channels to the closure compartment and through a connecting channel to a reservoir in the drum jacket that is always charged with closure fluid and subject to fluid pressure while the centrifugal drum is in operation and, secondly providing a connection that can be established when the closure compartment is being evacuated between it and the reservoir by opening a valve cone in the centrifugal valve.

The known piston valve, which is bounded on top by only the solids space and below by a small closure compartment, which is connected to an afflux channel and that, although it is longer, contains only a slight amount of closure field, allows both sudden opening during complete or partial discharge and sudden closing as a result of the way the invention connects the second centrifugal valve to the closure-fluid reservior. Since the closure fluid in the reservoir is subjected to a very high pressure in accordance with the diameter of the drum and with the speed at which it rotates, which may attain 25 bars or more, the closure compaartment can be immediately recharged with the highly pressurized closure fluid during or after discharge. The closure compartment is automatically charged through the second centrifugal valve as soon as the decreasing level of fluid in the compartment reduces its interior pressure and hence the pressure on the valve. The piston valve continues to open as long as control fluid is supplied to the first centrifugal valve.

The small closure compartment, with a capacity that is smaller than that of the reservoir, can be rapidly evacuated and just as rapidly recharged, which will make the piston-valve opening gap maximally wide even during discharge, whether partial or complete.

Other features and characteristics of the invention will be evident from the subsidiary claims and from the following specification and drawing wherein:

BRIEF DESCRIPTION OF THE DRAWING

The FIGURE is a partial sectional view of a centrifugal drum according to the invention.

DETAILED DESCRIPTION OF THE INVENTION

The suspension flows from access compartment 1 through channels 2 into solids space 3 and into a separation space 4 that consists of a series of disks, where it is clarified and separated by a known process. The solids space is demarcated above by drum cover 5 and below by an axially displaceable piston valve 6 that is sealed off in drum jacket 7 by ring seals 8 and 9. When the centrifugal drum is in operation, the piston valve is maintained in its upper, closure, position by a closure compartment 10 underneath it and charged with closure fluid. In this position the front of the piston valve works in conjunction with a ring seal 11 in drum cover 5 to seal off solids space 3 from expulsion openings 12 in the circumference of drum jacket 7 that allow the accumulated solids to be ejected . Closure compartment 10 is evacuated through an evacuation channel 13 that leads from its outer end to a fluid-activated centrifugal valve 14 that is itself connected by an afflux channel 15 to an annular channel 16 near the axis of the drum jacket and supplied with control fluid through a supply connection 17.

In drum jacket 7 is another centrifugal valve 18. Centrifugal valve 18 is connected to closure compartment 10 by a connecting channel 19 that begins at the circumference of the closure compartment and by a second connecting channel 20 that begins in the interior of the closure compartment. Centrifugal valve 18 is also connected to a reservoir 22 for closure fluid. The reservoir, which has a larger capacity than closure compartment 10, is demarcated above by drum jacket 7 and below by a cover plate 23 that is sealed from and fastened to the jacket by a ring seal 24. Since reservoir 22 is itself connected through annular compartment 25, and closure compartment 10 through access channel 26, to annular channel 27, the reservoir and the compartment can be jointly charged with closure fluid through annular channels 25 and 27 from a supply connection 28.

There is a safety outlet 29 bored between the two seals 9 in drum jacket 7 that prevents closure fluid from contaminating the suspension if one of the seals 9 should leak.

The centrifugal drum itself rotates on a central shaft 30. Its function will now be specified.

During operation, when centrifugal valves 14 and 18 are closed, closure compartment 10, channel 26, and reservoir 22 are charged with closure fluid. Piston valve 6 is in its upper, closure, position, in which it closes off expulsion openings 12.

When solids space 3 is full of solids and the drum is to be partially or completely discharged depending on the nature of the solids or of the suspension, centrifugal valve 14 is charged with control fluid through annular channel 16 and afflux channel 15 from supply connection 17. The fluid pressure that affects the front of valve cone 32 and that derives from the fluid in afflux channel 15 and annular channel 31 causes valve cone 32, which is subject to centrifugal force, to open evacuation channel 13, allowing closure fluid to escape from closure compartment 10 through outlets 33. As soon, however, as a small amount of closure fluid leaves closure compartment 10, afflux channel 26, which is also connected to closure compartment 10, will also be evacuated of closure fluid, upon which the fluid pressure below piston valve 6 will suddenly drop, allowing the pressure built up in solids space 3 and separation space 4 to force piston valve 6 just as suddenly down into its lower, opening, position. Part or all of the drum packing will now be expelled from solids space 3 through expulsion openings 12. Since evacuation channel 13 begins at the outer end of closure compartment 10, it is possible to completely evacuate the closure compartment, so that the piston valve can attain both its lowest possible position and a maximal opening width.

When the device is in operation, the second centrifugal valve 18, which is also in drum jacket 7 and connected to closure compartment 10 and to reservoir 22, is closed at first by valve cone 34, which is subject to centrifugal force, as the result of the fluid pressure on the rear of the valve cone in compartment 35 deriving through connecting channel 20 from closure compartment 10, so that compartment 39 between the valve cone and the drum jacket is vented through a channel 38. Valve cone 34 will, however, open as soon as the fluid pressure in closure compartment 10 and hence also in connecting channel 20 drops during discharge so that the fluid pressure in annular channel 36 and deriving from the channel 21 that is connected to reservoir 22 starts to preponderate at the front of the valve cone. This will establish a connection between reservoir 22 and closure compartment 10 through connecting channel 21, annular channel 36, connecting channel 37, and connecting channel 19, so that the highly pressurized closure fluid, which may attain 25 bars or more in accordance with the diameter of the drum and the speed at which it rotates, can flow immediately back into the closure compartment as soon as it is evacuated and can recharge it as soon as centrifugal valve 14 closes. Fresh closure fluid is simultaneously supplied during discharge to closure compartment 10 and reservoir 22 through annular compartments 25 and 27 from a supply connection 28.

The time required for centrifugal valve 14 and hence piston valve 6 to open is determined by the supply of control fluid as a function of either time or quantity. This supply can also be employed to determine the amount of solids to be centrifuged out of the solids space.

It will be practical for control and closure fluid to be supplied during discharge from supply connections 17 and 28 through appropriate controls, which are not illustrated.

It will be appreciated that the instant specification and claims are set forth by way of illustration and not limitation, and that various modifications and changes may be made without departing from the spirit and scope of the present invention.

What is claimed is:

1. A self-discharging centrifugal drum for clarifying and separating suspensions, the drum having a drum jacket, an axially displaceable piston valve that opens and closes expulsion openings in the circumference of the drum jacket to allow the removal of centrifuged solids, the piston valve being bounded by a solids space above and a closure compartment below into which closure fluid is chargeable and first fluid-activated centrifugal valving means in the drum jacket connected to the closure compartment by an evacuation channel that begins at the periphery of the closure compartment for vacating the closure compartment, the improvement comprising: means forming a closure fluid reservoir constantly filled with fluid under pressure during the operation of the centrifugal drum and second fluid-activated centrifugal valving means located in the drum jacket and connected to the closure compartment and to the reservoir for connecting the reservoir to the closure compartment when the closure compartment is being evacuated.

2. The self-discharging centrifugal drum according to claim 1, wherein the second valving means comprises a movable valve member, a first connecting channel at the outer periphery of the closure compartment and in communication therewith and a first connecting compartment at one outer face of the valve member and in communication with the first connecting channel.

3. The self-discharging centrifugal drum according to claim 2, wherein the second valving means further comprises a second connecting channel in communication with the closure compartment and a second connecting compartment at an inner face of valve member and in communication with the second connecting channel.

4. The self-discharging centrifugal drum according to claim 1, further comprising an access channel into the inner periphery of closure compartment and connectable to a supply of closure fluid.

5. The self-discharging centrifugal drum according to claim 3, wherein the second valving means further comprises a third connecting channel in communication with the reservoir and an annular channel at another outer face of the valve member in communication with the third connecting channel.

6. The self-discharging centrifugal drum according to claim 5, wherein the valving means has means connecting the annular channel to the first connecting compartment in response to the moving of the valve member.

7. The self-discharging centrifugal drum according to claim 1, wherein the means forming the reservoir comprises a closure plate below the drum jacket and fastened thereto to define the reservoir therebetween.

8. The self-discharging centrifugal drum as according to claim 1, wherein the capacity of the reservoir for closure fluid is larger than that of the closure compartment.

9. The self-discharging centrifugal drum according to claim 1, wherein the closure compartment and the closure fluid reservoir are chargeable with closure fluid from a joint supply connection through annular channels near the axis of the drum jacket.

* * * * *